US006386783B1

(12) United States Patent
Spoelman

(10) Patent No.: US 6,386,783 B1
(45) Date of Patent: May 14, 2002

(54) TOOTHPASTE DISPENSING TOOTHBRUSH

(76) Inventor: Derrik J. Spoelman, 2929 E. Jasmine St., Mesa, AZ (US) 85213

( * ) Notice: Subject to any disclaimer, the term of this patent is extended or adjusted under 35 U.S.C. 154(b) by 0 days.

(21) Appl. No.: 09/669,217

(22) Filed: Sep. 25, 2000

(51) Int. Cl.[7] ..... A46B 11/04
(52) U.S. Cl. ..... 401/270; 401/268
(58) Field of Search ..... 401/270, 277, 401/268, 171, 172, 173, 174, 176

(56) References Cited

U.S. PATENT DOCUMENTS

| | | | | |
|---|---|---|---|---|
| 3,653,778 A | | 4/1972 | Freiling | |
| 4,116,570 A | | 9/1978 | Parenti | |
| 4,201,490 A | * | 5/1980 | D'Angelo | 401/270 |
| 4,693,622 A | | 9/1987 | Booth | |
| 4,733,983 A | | 3/1988 | Hertrampf | |
| 5,066,155 A | | 11/1991 | English et al. | |
| 5,407,287 A | | 4/1995 | Braun et al. | |
| 5,909,977 A | | 6/1999 | Kuo | |
| 6,027,273 A | | 2/2000 | Li | |
| 6,056,466 A | | 5/2000 | Johnson et al. | |

* cited by examiner

*Primary Examiner*—David J. Walczak
(74) *Attorney, Agent, or Firm*—Parsons & Goltry; Robert A. Parsons; Michael W Goltry

(57) ABSTRACT

A toothpaste dispensing toothbrush including a handle defining a reservoir, and a neck extending from the handle and terminating in a brush head. The reservoir has an outlet, and contains a plurality of portions of toothpaste. The brush head has a plurality of bristles with an effective lifetime. A passage extends from the outlet of the reservoir through the neck to a dispensing opening located proximate the brush head. Also included is a dispensing mechanism for dispensing the plurality of portion of the toothpaste from the reservoir to the brush head. The plurality of portions of toothpaste matches the lifetime of the bristles.

2 Claims, 1 Drawing Sheet

TOOTHPASTE DISPENSING TOOTHBRUSH

FIELD OF THE INVENTION

This invention relates to dental hygiene devices.

More particularly, the present invention relates to toothbrushes.

In a further and more specific aspect, the instant invention concerns toothpaste dispensing toothbrushes.

BACKGROUND OF THE INVENTION

Toothbrushes have long been known and used to clean teeth. A brush typically includes a handle and an end supporting a large number of bristles. Toothpaste is applied to the bristles to aid in cleaning teeth. The use of a cleaning paste requires an additional container to hold and dispense the cleaning paste. The containers holding the toothpaste often come in the form of a squeezable tube. The combination of these devices has been used for many years, and is extremely effective. However, multiple pieces, such as a brush and a tube, reduces convenience and requires an individual to keep track of two separate elements, each of which is needed in the tooth cleaning process.

To overcome this problem, dispensing toothbrushes have been developed. These toothbrushes include reservoirs in their handles that contain toothpaste. To undergo the cleaning process, a portion of toothpaste is dispensed from the handle to the bristles. This is extremely convenient, because if the brush is present, so is the toothpaste.

Again, while dispensing toothbrushes are effective, they have a serious drawback. Overuse of a toothbrush radically reduces the effectiveness of the cleaning process. Specifically, after a period of use, the bristles of a toothbrush are worn and are much less effective at removing materials from teeth. However, both conventional toothbrushes and dispensing brushes can be used for unlimited periods of time simply by providing more toothpaste.

It would be highly advantageous, therefore, to remedy the foregoing and other deficiencies inherent in the prior art.

Accordingly, it is an object of the present invention to provide a new and improved toothpaste dispensing toothbrush.

Another object of the invention is to provide a toothpaste dispensing toothbrush which supplies toothpaste for the life of the toothbrush.

And another object of the invention is to provide toothpaste dispensing toothbrush which runs out of toothpaste at the effective end of the lifetime of a toothbrush.

SUMMARY OF THE INVENTION

Briefly, to achieve the desired objects of the instant invention in accordance with a preferred embodiment thereof, provided is a toothpaste dispensing toothbrush including a handle defining a reservoir, and a neck extending from the handle and terminating in a brush head. The reservoir has an outlet, and contains a plurality of portions of toothpaste. The brush head has a plurality of bristles with an effective lifetime. A passage extends from the outlet of the reservoir through the neck to a dispensing opening located proximate the brush head. Also included is a dispensing mechanism for dispensing the plurality of portion of the toothpaste from the reservoir to the brush head. The plurality of portions of toothpaste matches the lifetime of the bristles.

Also provided is a method of cleaning teeth utilizing the toothpaste dispensing toothbrush. The method includes dispensing toothpaste to the brush head and brushing the teeth. The steps are repeated until the toothpaste is from the reservoir, indicating that the end of the lifetime of the bristles has been reached. The toothpaste dispensing toothbrush is then discarded.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
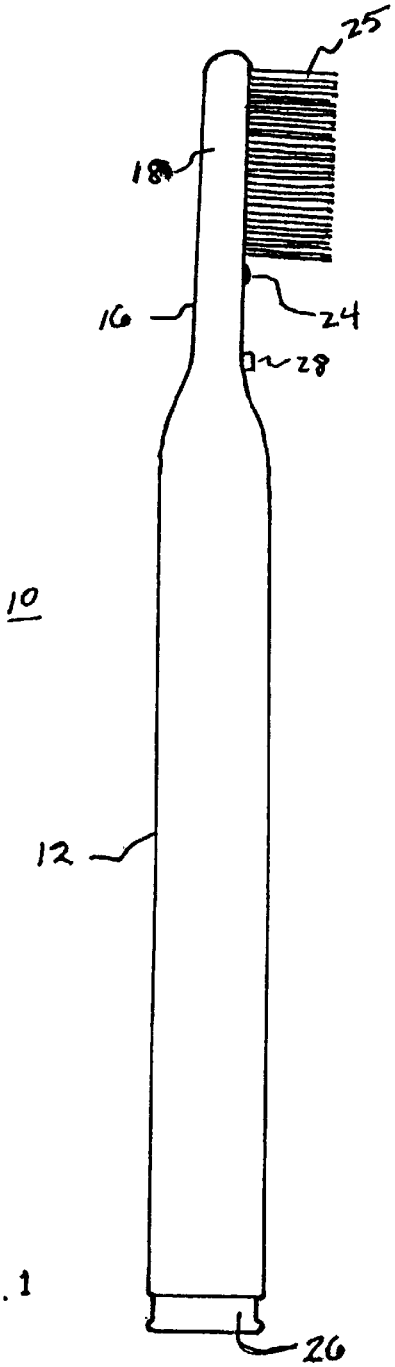
FIG. 1 is a plan view of a toothpaste dispensing toothbrush according to the present invention.
Figure 2:
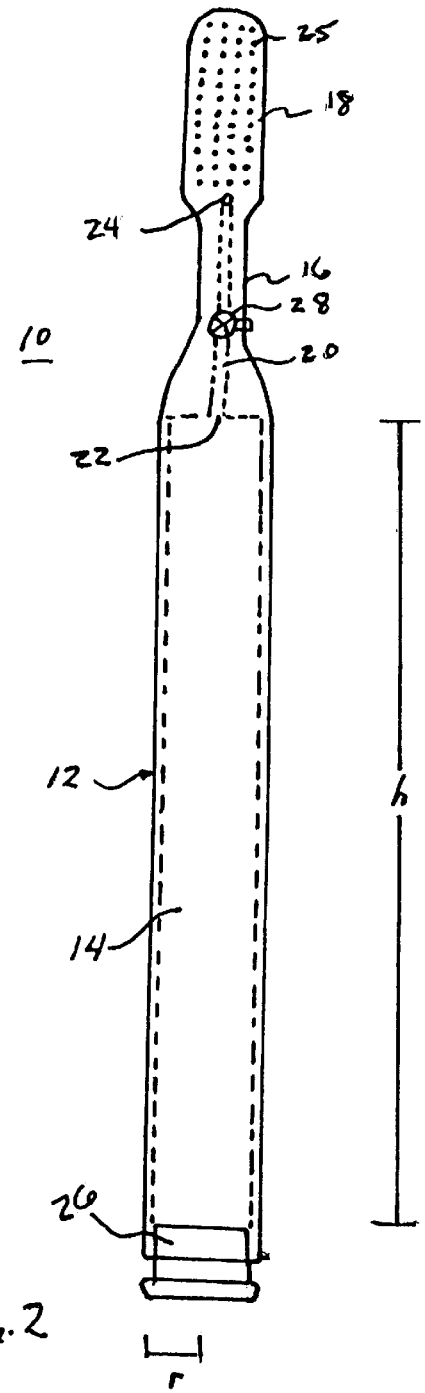
FIG. 2 is schematic diagram illustrating the toothpaste dispensing toothbrush of FIG. 1.

Turning now to the drawings in which like reference characters indicate corresponding elements throughout the several views, attention is directed to FIGS. 1 and 2 which illustrate a toothpaste dispensing toothbrush generally designated 10. Toothpaste dispensing toothbrush 10 includes a handle 12 containing a reservoir 14. In this preferred embodiment, handle 12 is generally cylindrical, and defines a generally cylindrical space, reservoir 14. A neck 16 extends from handle 12 and terminates in a brush head 18. A passage 20 extends from an outlet 22 of reservoir 14 through neck 16 to a dispensing opening 24 located proximate brush head 18. Brush head 18 has a plurality of bristles 25 extending therefrom. Bristles 25 have a lifetime during which they are the most effective in cleaning teeth. After a period of use equal to the lifetime, the bristles become much less effective. Toothbrush manufactures and dentists suggest disposing of the toothbrush after the bristles have reached the end of their lifetime. Conventional bristles on toothbrushes typically last for approximately three months with two uses per day, or approximately 180 cleaning events. At this time, a new toothbrush should be used as recommended by toothbrush manufactures and dentists.

With additional reference to FIG. 2, a dispensing mechanism 26 is mounted in handle 12 for dispensing single portions of toothpaste carried within reservoir 14. The dispensing mechanism forces a portion of toothpaste from reservoir 14, through passage 20 and out dispensing opening 24 to brush head 18. In the preferred embodiment, a closure mechanism, in this embodiment a valve 28, is located in neck 16 closing passage 20 proximate dispensing opening 24. It will be understood that while valve 28 is positioned proximate dispensing opening 24, it can be placed anywhere along passage 20. Furthermore, the closure mechanism can be a plug or like element for closing dispensing opening 24. If desired, the closing mechanism can be omitted, but this may allow the toothpaste to dry out. Detailed descriptions of dispensing mechanism 26 and the closure mechanism have been omitted as they are well known in the art. Numerous toothpaste dispensing toothbrushes are known which employ various different dispensing mechanisms and closure mechanisms, such as pumps and valves. Any of these devices can be employed in the present invention.

Reservoir 14 is sized to contain sufficient portions of toothpaste to last the lifetime of bristles 25. When the portions are exhausted, bristles 25 have reached the end of their lifetime. Thus, using the last portion of toothpaste within reservoir 14 is an indicator that toothpaste dispensing toothbrush 10 should be discarded and a new one employed. In this manner, optimal bristles are provided during brushing events to aid in maintaining the dental health of an individual.

While the quantity of toothpaste within each portion can be altered as desired, the quantity recommended by toothbrush manufactures and dentists will be described and used in calculating a volume of reservoir 14 as an example. One skilled in the art will readily understand that the portions can be increased or decreased in quantity with a corresponding increase or decrease in the volume of reservoir 14. Furthermore, while 180 brushing events and therefore the number of portions used will be employed in the example as the lifetime of the bristles, one skilled in the art will understand that this is intended to be a general guideline for conventional bristles. It is contemplated that bristles may be used which have a shorter or longer lifetime. In this event, the volume of reservoir 14 and portions sizes can be altered as needed.

In a specific example, the recommended portion size is approximately 0.00785 cubic inches of toothpaste. This equates to a cylinder of toothpaste having a radius of 0.1 inches and a length of 0.25 inches. The amount of toothpaste can be determined from the following equation:

$$V=\Pi r^2 h$$

Wherein V is the quantity of toothpaste per portion, r is the radius of the cylinder of toothpaste, and h the length of the cylinder of toothpaste.

Thus, a portion:

$$0.00785 \text{ cubic inches}=\Pi(0.1 \text{ inches})^2(0.25 \text{ inches})$$

Assuming 180 portions are needed to cover the entire lifetime of bristles 25, and reservoir 14 is generally cylindrical, the volume of reservoir 14 can be determined using the same equation listed above. In this instance, the radius of reservoir 14 is 0.3 inches, and the length is 5 inches.

Thus, the reservoir:

$$1.413 \text{ cubic inches}=(3.14)(0.3 \text{ inches})^2(5 \text{ inches})$$

Thus, portions in the reservoir:

$$1.413/00.785=180$$

As will be understood, the proceeding is a specific example, and any of the variables can be changed.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is.

1. A method of cleaning teeth comprising the steps of:

providing a toothpaste dispensing toothbrush including a handle containing a reservoir having an outlet, a plurality of measured portions of toothpaste contained within the reservoir, each portion sufficient for a single cleaning use, a neck extending from the handle and terminating in a brush head having a plurality of bristles with a lifetime including a plurality of cleaning uses, a passage extending from the outlet of the reservoir through the neck to a dispensing opening located proximate the brush head, a dispensing mechanism for dispensing the plurality of portions of the toothpaste from the reservoir to the brush head, and the plurality of portions matching the plurality of cleaning uses;

dispensing one of the portions of the toothpaste to the brush head; and brushing teeth with the brush head.

2. A method as claimed in claim 1, further including repeating the steps of dispensing and brushing until all of the portions have been dispensed, indicating that the bristles have reached the end of their lifetime, and disposing of the toothpaste dispensing toothbrush.

* * * * *